United States Patent [19]

Terui

[11] Patent Number: 4,838,022

[45] Date of Patent: Jun. 13, 1989

[54] CONTROL SYSTEM FOR CONTROLLING DC CONTROL MOTOR WHICH CONTROLS OPERATION CONDITION OF INTERNAL COMBUSTION ENGINE

[75] Inventor: Toshiyasu Terui, Iwata, Japan

[73] Assignee: Yamaha Hatsudoki Kabushiki Kaisha, Japan

[21] Appl. No.: 161,851

[22] Filed: Feb. 29, 1988

[30] Foreign Application Priority Data

Mar. 2, 1987 [JP] Japan ..... 62-45286
Mar. 2, 1987 [JP] Japan ..... 62-45287

[51] Int. Cl.[4] ..... F02B 27/02

[52] U.S. Cl. ..... 60/312; 60/313; 123/479; 123/487

[58] Field of Search ..... 60/313, 312; 123/479, 123/487

[56] References Cited

U.S. PATENT DOCUMENTS 3,895,611 7/1975 Endo ..... 123/487
4,196,702 4/1980 Bowler ..... 123/487

*Primary Examiner*—Douglas Hart
*Attorney, Agent, or Firm*—Laff, Whitesel, Conte & Saret

[57] ABSTRACT

A control system for controlling a DC control motor which controls an internal combustion engine to follow-up a target value varying continuously depending on the operation condition of the engine, the current flowing through the DC control motor being controlled through pulse width modulation. The control system comprises: means for detecting the operation condition of the engine; processor means for calculating and setting a target value depending on the operation condition of the engine; detector means for detecting the up-to-date value of the DC control motor; discriminator means for discriminating a difference between the target value and the up-to-date value to supply an output signal for changing the duty ratio of the current flowing through the DC control motor depending on the difference; a driver for energizing the DC control motor in response to the output signal from the discriminator means; and controller means for monitoring the duty ratio of the current flowing through the DC control motor and for stopping the DC control motor for a predetermined time period when the time duration during which the duty ratio takes a value higher than a programmed duty ratio reaches a pre-set time duration. In another embodiment, the aforementioned monitoring means is replaced by the monitor means for controlling the changing rate of the up-to-date value and for increasing the duty ratio when the changing rate of the up-to-date value is less than a programmed rate.

11 Claims, 5 Drawing Sheets

CONTROL SYSTEM FOR CONTROLLING DC CONTROL MOTOR WHICH CONTROLS OPERATION CONDITION OF INTERNAL COMBUSTION ENGINE

BACKGROUND OF THE INVENTION

1. Field of the Invention

The present invention relates generally to a control system for controlling operation condition of an engine for a motor vehicle, and particularly to a control system for controlling a DC control motor which controls operation of an internal combustion engine to follow-up a target value varying continuously depending on the operation condition of the engine.

2. Prior Art Statement

During cruising of a motor vehicle, the rotation speed of the engine is changed greatly and the loading applied on the engine is also changed within a wide range. In consideration of the foregoing, it has been proposed to detect the operation conditions of the engine and to open or closed a variety of control valves depending on the result of detection so as to achieve optimum control of the engine. For example, Japanese Patent Laid-Open Publication No. 126222/1987 teaches a system wherein an exhaust gas control valve is disposed at a vicinity of the downstream end of the exhaust pipe, and the exhaust gas control valve is fully opened to utilize the kinetic effect of the exhaust system at the maximum extent so as to increase the output of the engine when the engine is operated within its high speed range. The exhaust gas control valve is closed to about one half of the full open angle, when the engine is operated within its medium speed range, to prevent formation of trough of torque due to the reverse effect of kinetics in the exhaust system. Another proposal has been made to change the effective length of the exhaust pipe by the provision of control valves on the connection pipes connecting the plural exhaust pipes and by opening or closing the control valves depending on the change in rotation speed of the engine.

When such a control valve is opened and closed by means of a DC motor which is controlled through pulse width modulation system (hereinafter referred to as "PWM system"), the duty ratio of the current flowing through the DC motor is controlled depending on the difference between the target value and the up-to-date value and/or depending on the change in loading applied on the DC motor. However, in the event where carbon or dust sticks to the control valve to increase the loading applied on the DC motor, the motor is operated at a higher duty ratio for a long time, leading to a result that the current flowing through the DC motor becomes excessively high to raise the temperature of the motor and eventually to cause burn-out of the motor.

On the contrary, in the event where the difference between the target value and the up-to-date value is relatively small and the duty ratio is also small and where carbon or dust sticks to the control valve to increase the torque for actuating the control valve, the control valve cannot be moved by he motor to be kept stopping.

OBJECTS AND SUMMARY OF THE INVENTION

A first object of this invention is to provide a control system for controlling a DC control motor which controls an internal combustion engine to follow-up a target value varying continuously depending on the operation condition of the engine by controlling the current flowing through the DC control motor by pulse width modulation, wherein the DC control motor is prevented from application of excessively high loading and wherein unduly temperature raise or burn-out of the motor, due to prolongation of the condition at which the duty ratio of the current flowing through the motor is too high, is obviated.

A second object of this invention is to provide such a control system which solves the aforementioned problem that the control valve cannot be moved by the DC control motor in the event where the difference between the target value and the up-to-date value is relatively small and the duty ratio is also small and where carbon or dust sticks to the control valve to increase the torque for actuating the control valve.

According to a first aspect of this invention, provided is a control system for controlling a DC control motor which controls an internal combustion engine to follow-up a target value based on the operation condition of the engine through pulse width modulation, wherein the duty ratio of the current flowing through the DC control motor is monitored and the DC control motor is stopped for a predetermined period after the duty ratio has been maintained at a ratio higher than the programmed ratio for a pre-set time duration. It is thus possible to prevent a high current from flowing through the DC control motor over a period longer than the pre-set time duration, thereby to eliminate the problem of excessive temperature raise of the DC control motor which might lessen the lifetime of the motor.

According to a second aspect of this invention, provided is a control system for controlling a DC control motor which controls an internal combustion engine to follow-up a target value based on the operation condition of the engine through pulse width modulation, wherein the speed of the DC control motor is monitored and the duty ratio of the current flowing through the DC control motor is increased when the changing rate of the up-to-date value is less than the programmed rate. It is thus possible to ensure actuation of the DC control motor even if the difference between the target value and the up-to-date value is small or the loading applied on the DC control motor is high.

The first object of this invention is achieved by the provision of a control system for controlling a DC control motor which controls an internal combustion engine to follow-up a target value varying continuously depending on the operation condition of said engine, the current flowing through said DC control motor being controlled through pulse width modulation, said control system comprising:

means for detecting the operation condition of said engine;

processor means for calculating and setting a target value depending on said operation condition of said engine;

detector means for detecting the up-to-date value of said DC control motor;

discriminator means for discriminating a difference between said target value and said up-to-date value to supply an output signal for changing the duty ratio of the current flowing through said DC control motor depending on said difference;

a driver for energizing said DC control motor in response to said output signal from said discriminator means; and controller means for controlling said duty ratio of the current flowing through said DC control motor and for stopping said DC control motor for a predetermined time period when the time duration during which said duty ratio takes a value higher than a programmed duty ratio reaches a pre-set time duration.

The second object of this invention is achieved by the provision of a control system for controlling a DC control motor which controls an internal combustion engine to follow-up a target value varying continuously depending on the operation condition of said engine, said DC control motor being controlled through pulse width modulation, said control system comprising:

means for detecting the operation condition of said engine;

processor means for calculating and setting a target value depending on said operation condition of said engine;

detector means for detecting the up-to-date value of said DC control motor;

discriminator means for discriminating a difference between said target value and said up-to-date value to supply an output signal for changing the duty ratio of the current flowing through said DC control motor depending on said difference;

a driver for energizing said DC control motor in response to said output signal from said discriminator means; and monitor means for monitoring the changing rate of said up-to-date value and for increasing said duty ratio when said changing rate of said up-to-date value is less than a programmed rate.

DESCRIPTION OF THE APPENDED DRAWINGS

The above and other objects and advantages of this invention will be apparent from the following detailed description of preferred embodiments thereof with reference to the appended drawings, in which.

DESCRIPTION OF PREFERRED EMBODIMENTS

Figure 1:
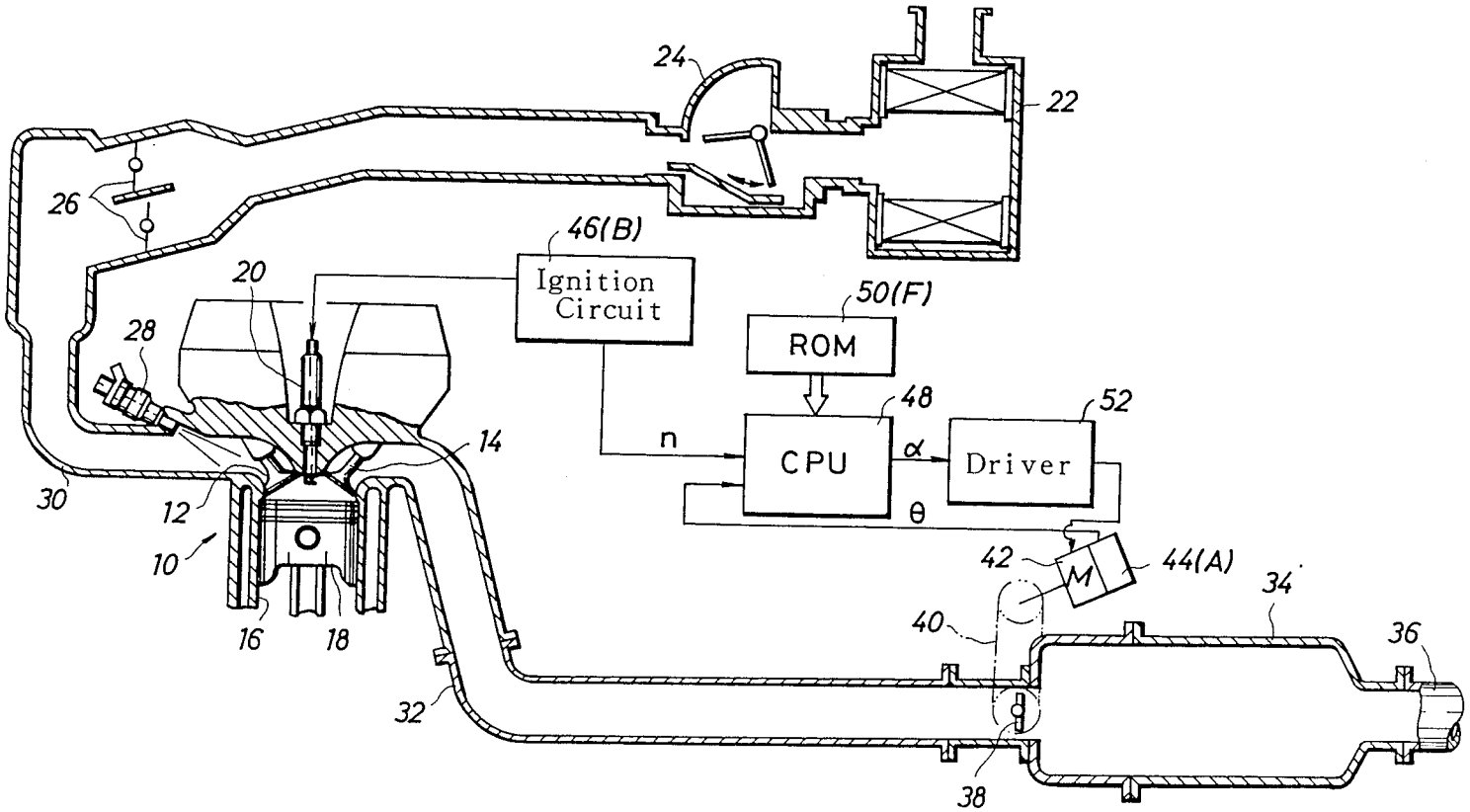
FIG. 1 is a schematic view showing an embodiment of the control system, according to this invention, which is associated with an exhaust system of an internal combustion engine.
Figure 2:
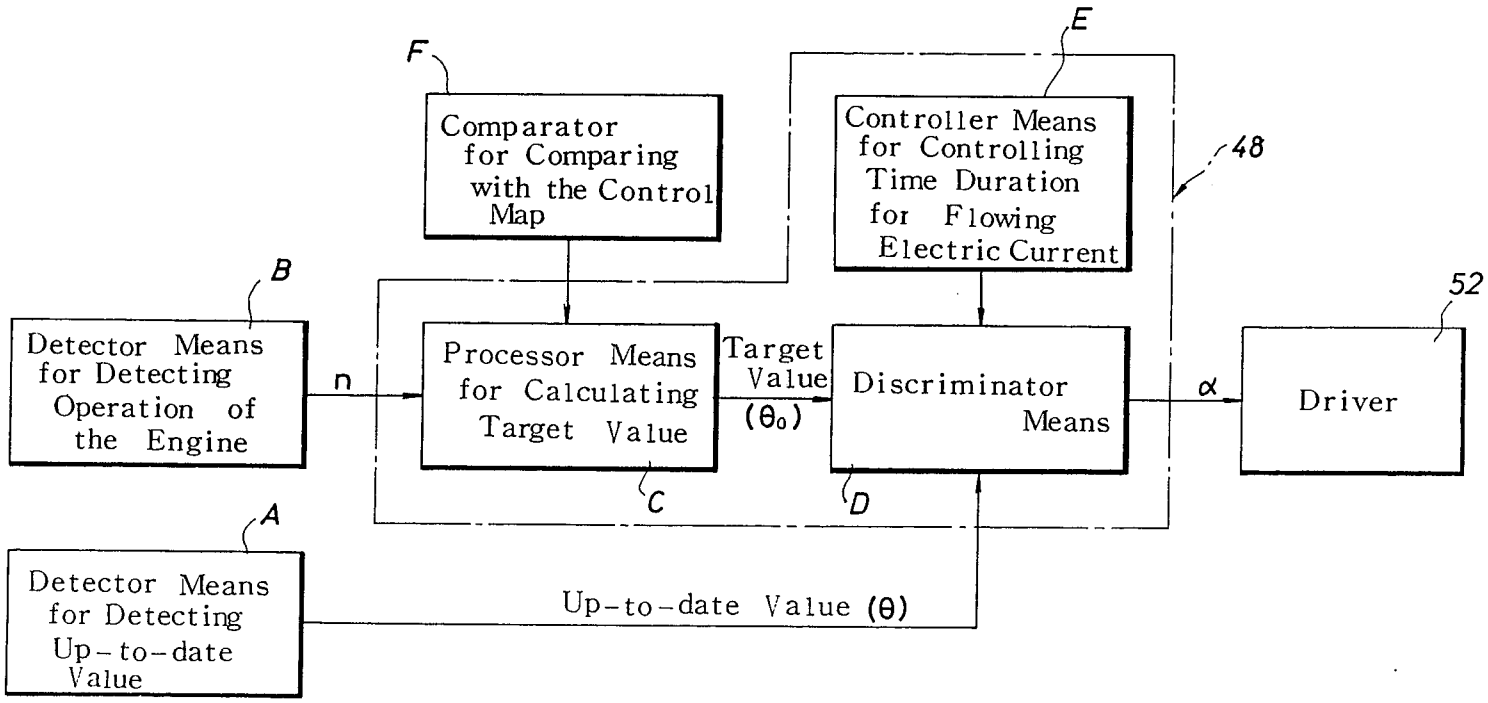
FIG. 2 is a block diagram showing the control system of FIG. 1.
Figure 3:
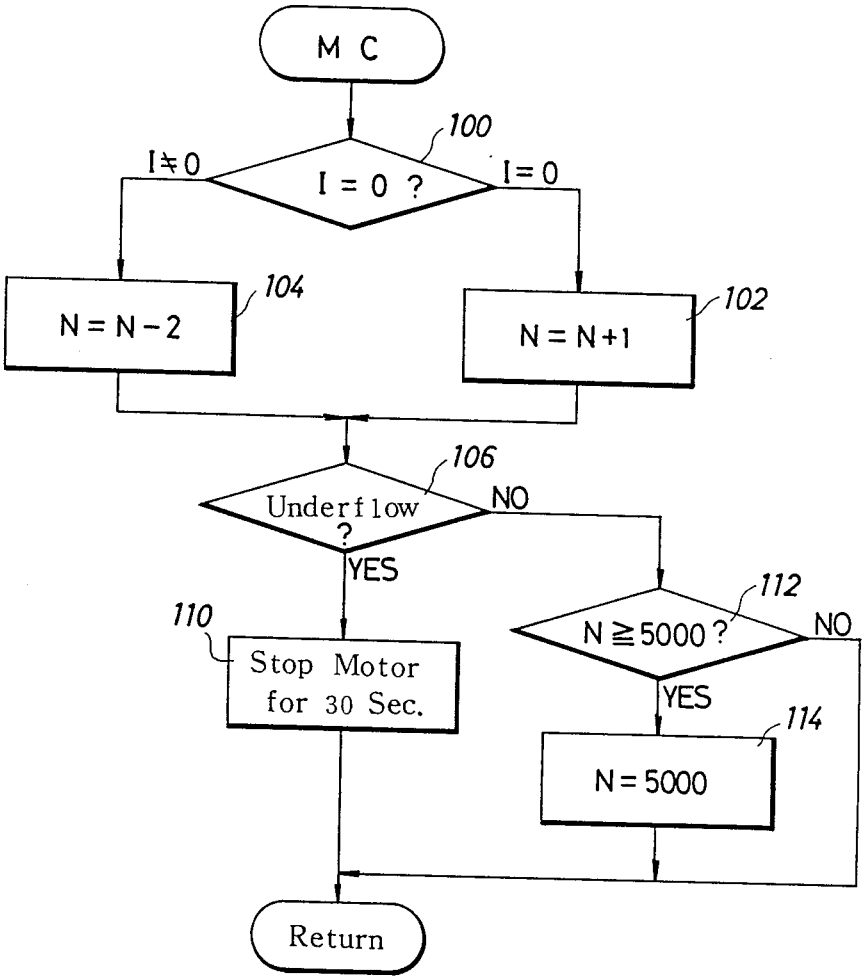
FIG. 3 is a flow chart showing the operation of the control system of FIG. 2.

Referring to FIGS. 1 to 3, a first embodiment of this invention will now be described in detail. Initially referring to FIG. 1, a four-cycle internal combustion engine is denoted by 10, and has an intake valve 12 and an exhaust valve 14 which are opened and closed by valve actuating means (not shown) at predetermined timing. The engine 10 is further provided with a cylinder 16, a piston 18 which cooperates with the cylinder 16, and an ignition plug 20 which ignites the compressed fuel-air mixture in the cylinder 16. The intake system of the engine 10 includes an air cleaner 22, an air flow meter 24, a throttle valve 26 and a fuel injection valve 28. Air is sucked through the air cleaner 22 at a flow rate determined by the rotation speed of the crank shaft (not shown) of the engine 10 and the open angle of the throttle valve 26. The flow rate of the sucked air is measured by the air flow meter 24. The optimal quantity of fuel corresponding to the sucked air quantity and adapted to the operation conditions (for example, temperature of the engine) is calculated by a computer (not shown) and supplied through a fuel injection valve 28 which injects the supplied fuel into the intake pipe 30.

The exhaust system includes a first exhaust pipe 32 having one end opened and closed by the exhaust valve 14, an expansion chamber 34 connected with the other or downstream end of the first exhaust pipe 32, and a second exhaust pipe 36 connected to the downstream end of the expansion chamber 34. A control valve, a butterfly valve 38 in the illustrated embodiment, is disposed at a vicinity of the downstream end of the fist exhaust pipe 32 to control the flow of exhaust gases. The control valve 38 is opened and closed by an actuator, a DC servomotor 42 in the illustrated embodiment, through a wire 40. The servomotor 42 is fitted with a potentiometer 44 which serves as the means A for detecting the up-to-date open angle $\theta$ (i.e. the up-to-date value) of the control valve 38 by detecting the angular position of the servomotor 42.

The ignition plug 20 is connected to an ignition circuit 46 which is utilized as the means B for detecting the operation condition of the engine 10. The rotation speed n of the engine 10 is detected from the ignition circuit 46. A central processor unit (CPU) or digital microprocessor is generally denoted by 48 and includes a processor C for calculating and setting the target value, a discriminator D, and controller means E for controlling the time duration for flowing electric current. The processor C reads-out the data corresponding to the rotation speed n from a read-only memory (ROM) which stores a control map, and calculates the target open angle $\theta_0$ of the control valve 38. The ROM 50 is shown as the comparator means F for comparing with the control map in FIG. 2. The discriminator D discriminates the difference between the target open angle $\theta_0$ and the up-to-date open angle $\theta$ to generate a control signal $\alpha$ which is fed to a driver 52. When the signal $\alpha$ is a signal for controlling the electric current flowing through the servomotor 42, for example, by the pulse width modulating system, the duty ratio of the current flowing through the servomotor 42 is changed depending on the difference between $\theta_0$ and $\theta$, and also depending on the change in loading applied on the servomotor 42. The flow direction of the electric current is determined so that the open angle of the control valve 38 is increased when 0 is smaller than $\theta_0$ and the open angle of the control valve 38 is decreased when $\theta$ is larger than $\theta_0$.

The controller means E for controlling the time duration for flowing electric current monitors the duty ratio of the current flowing through the servomotor 42 and generates a stop signal & for stopping the servomotor 42 for a pre-set period when the time duration during which the duty ratio is higher than the programmed duty ratio is continued beyond the pre-set time duration. The discriminator D stops the servomotor 42 in response to the stop signal & .

The operation of the illustrated embodiment will now be described with reference to FIG. 3. The illustrated embodiment operates to repeat the operation sequence including the sub-routine shown in FIG. 3 within every predetermined time period, for example within 2 milliseconds. One cycle period for flowing the current through the servomotor is set to 2 milliseconds×4=8 milliseconds. Within this one cycle period, the duty ratio of the current may be changed stepwisely to take a value which is shifted from one to four times of 2 milliseconds. At the initial step of the sub-routine shown in FIG. 3, CPU 48 discriminates whether the current I flowing through the servomotor 42 is zero or not (Step 100). The adder-subtracter counter contained in CPU 48 stores a pre-set count number N, for example 5000. If I=0, 1 is added to the count number (Step 102). If I≠0, 2 is subtracted from the count number(Step 104). In the event where the count number N underflows below zero as the result of addition and subtraction (Step 108), the discriminator means D stops the servomotor 42 for a predetermined time period, e.g. for-30 seconds (Step 110).

In case where the count number N has not underflown, the count number N is checked whether it is larger than 5000 or not (Step 112). If the count number N is larger than 5000, it is reset to 5000 (Step 114).

When the duty ratio is maintained at $\frac{1}{3}$, the count number N is not changed as will be seen from the following equation of:

$$N + (1 \times \tfrac{2}{3}) - (2 \times \tfrac{1}{3})$$

However, as the duty ratio is larger than $\frac{1}{3}$, the count number N is reduced. The larger is the duty ratio, the sooner the count number reaches to the underflown condition. For instance, if the duty ratio is maintained at 100%, the count number N underflows after the lapse of:

2+5000=1000 milliseconds=10 seconds. In general, the time duration within which the servomotor 42 is allowed to operate is varied depending on the duty ratio. According to this embodiment, the time duration for allowing the servomotor to operate may be varied corresponding to the duty ratio. Accordingly, the servomotor may be controlled to match with its performance characteristic.

However, the present invention is not limited only to the aforementioned embodiment. For example, the servomotor 42 may be operated at a constant duty ratio while monitoring the duty ratio flowing therethrough, and the servomotor 42 is stopped when it is discriminated that the servomotor has been operated at the constant duty ratio for a predetermined time.

Figure 4:
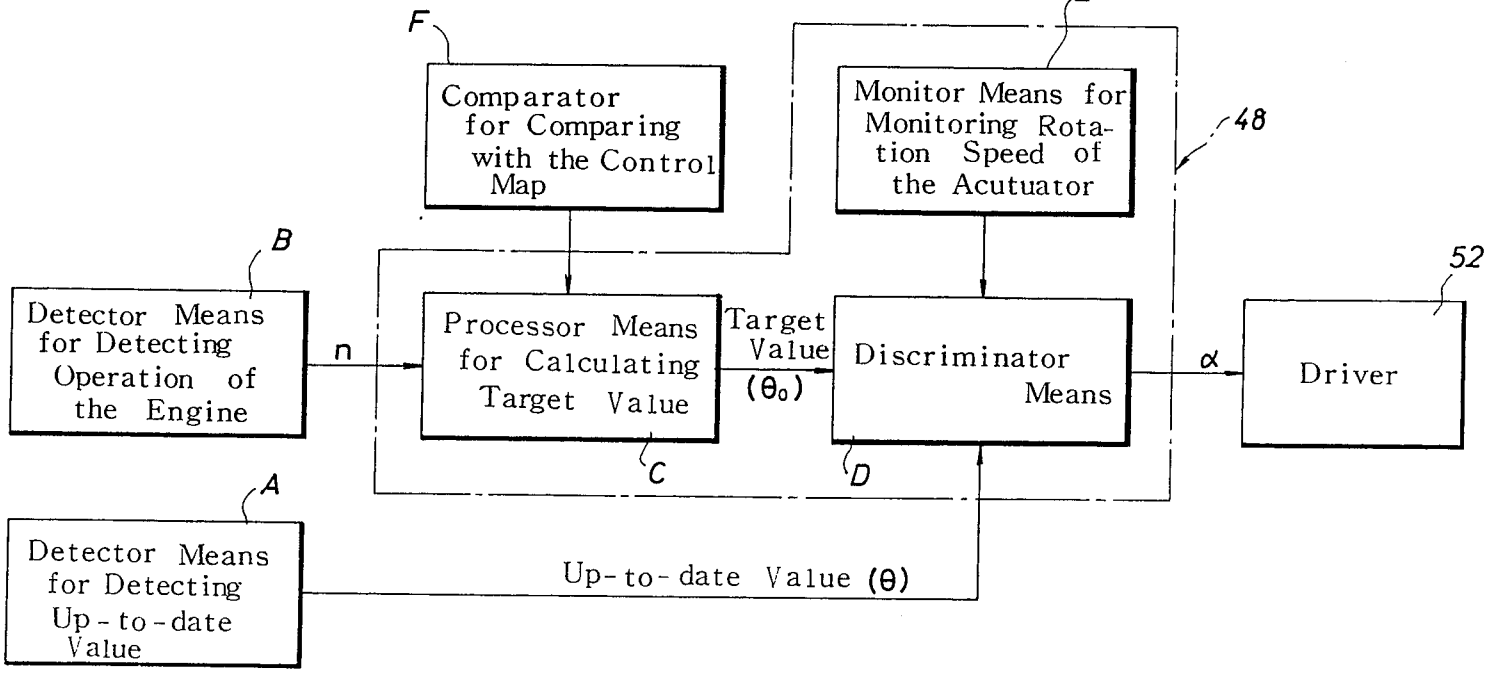
FIG. 4 is a schematic view showing another embodiment of the control system, according to this invention.
Figure 5:
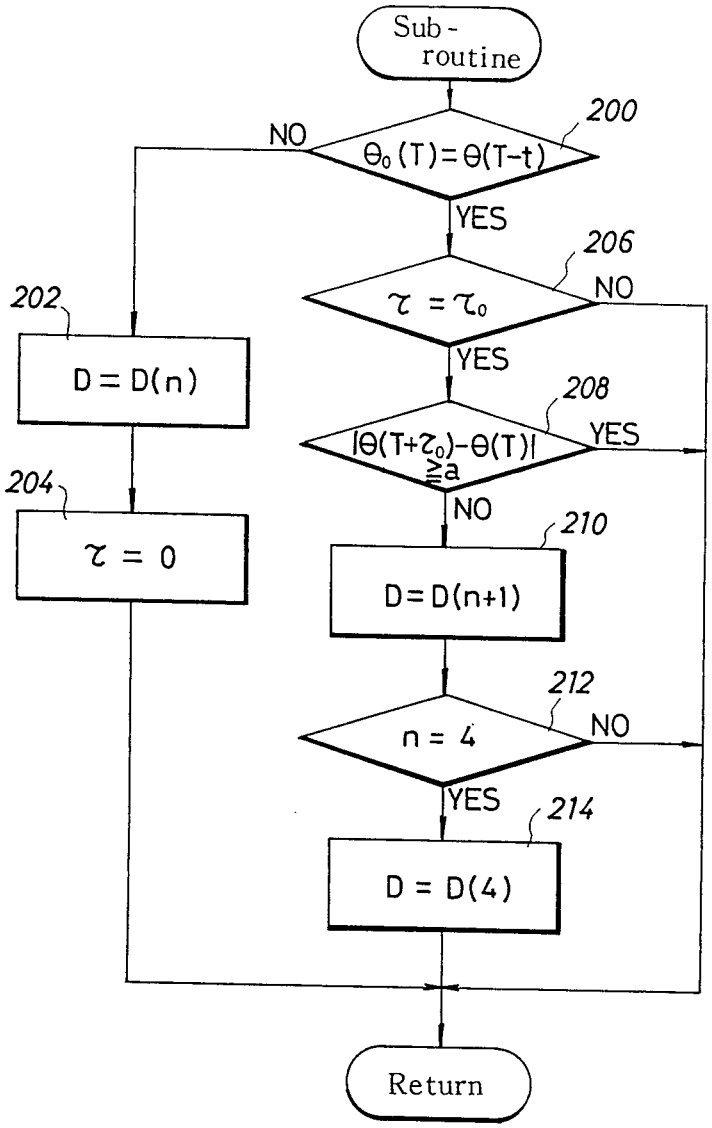
FIG. 5 is a flow chart showing the operation of the control system of FIG. 5.

A second embodiment of this invention is schematically shown in FIG. 4, and the operation thereof is shown in the flow chart of FIG. 5. The general construction of the second embodiment is similar to that of the first embodiment shown in FIG. 1, except that the control means E for controlling the time duration for flowing electric current is replaced by monitor means E′ for monitoring the rotation speed of the actuator (servomotor 42) as shown in FIG. 4.

The rotation speed monitor means E′ monitors the rotation speed of the servomotor. Since the rotation speed of the actuator or servomotor is determined depending to the load applied thereto, a signal is fed to the discriminator means D to increase the duty ratio stepwisely when the rotation speed is less than a programmed level.

The operation of the second embodiment will now be described with reference to FIG. 5. In this embodiment, the duty ratio may be selected stepwisely from the four ratios D(l), D(2), D(3) and D(4). D(l) means that the duty ratio is 25%, D(2) means that the duty ratio is 50%, D(3) means that the duty ratio is 75%, and D(4) means that the duty ratio is 100%. CPU 48 repeats the sub-routine of FIG. 5 within every 2 millisecond cycle. At the initial step, CPU 48 discriminates whether the target value $\theta$ is changed or not (Step 200). For this purpose, the target value $\theta_0$ at time T is compared with the target value $\theta_0(T-t)$ at the time before the time T by t. If the change in target value $\theta_0$ is smaller than a predetermined range, it is judged that the target value is not changed. If the change in target value $\theta_0$ is larger that the predetermined range, it is judged that the target value $\theta_0$ is changed. In case where the target value $\theta_0$ is changed, new duty ratio D(n) corresponding to the new target value $\theta_0(T)$ is calculated by using the data stored in ROM 50 (Step 202), and counting of the time duration $\tau$ is initiated from the standard time T (Step 204).

After the lapse of one cycle period (after 2 milliseconds), it is discriminated again to know whether the target value $\theta_0$ is changed or not (Step 200). If the target value $\theta_0$ is not changed at this time, the up-to-date value $\theta(T+\tau_0)$ is read-in at the point when the counted time reaches $\tau=\tau_0$ (Step 206). The difference of the up-to-date value $\theta(T+\tau_0)$ and the up-to-date value $\theta(T)$ at the time point T is discriminated to judge whether the difference is more than the pre-set value a or not (Step 208). This operation is the one for learning the rotation speed of the servomotor 42, since the movement within a predetermined time period is obtained thereby, the movement being represented by the following equation of:

$$\{\Theta(T + \tau_0) - \Theta(T)\}/\tau_0$$

If the absolute value of the rotation speed is more than a programmed value $a/\tau_0$, it is judged that the load applied on the servomotor 42 is not excessively high to continue the operation at the duty ratio D(n) determined at the step 202.

If the absolute value of the rotation speed is less than a programmed value $a/\tau_0$, it is judged that the load applied on the servomotor 42 is excessively high to raise the duty ratio of the current flowing through the servomotor 42 by one step (Step 210). For example, the duty ratio is raised from D(l) to D(2), from D(2) to D(3), and from D(3) to D(4), respectively. If the duty ratio D before this step 210 is D(4), the operation is continued at the duty ratio D(4) since no higher duty ratio is not present (Steps 212 and 214).

As will be seen from the foregoing, since the duty ratio is raised stepwisely one by one if the rotation speed of the servomotor 42 is less than the pre-set level, the current flowing through the servomotor 42 is increased to ensure the actuation thereof.

In this embodiment, the present invention is applied for the actuation of the exhaust gas control valve 38 disposed at the downstream end of the exhaust pipe 32 so that the valve 38 is opened when the engine is operated within its high speed range and the valve 38 is closed when the engine is operated within its medium speed range to prevent formation of trough of torque. However, the present invention may be applied to control other control valves. For example, a control valve for controlling the effective pipe length of an intake pipe may be controlled within the scope and spirit of this invention.

What is claimed is:

1. A control system for controlling a DC control motor which controls an internal combustion engine to follow-up a target value varying continuously depending on the operation condition of said engine, the current flowing through said DC control motor- being controlled through pulse width modulation, said control system comprising:

means for detecting the operation condition of said engine;

processor means for calculating and setting a target value depending on said operation condition of said engine;

detector means for detecting the up-to-date value of said DC control motor;

discriminator means for discriminating a difference between said target value and said up-to-date value to supply an output signal for changing the duty ratio of the current flowing through said DC control motor depending on said difference;

a driver for energizing said DC control motor in response to said output signal from said discriminator means; and controller means for controlling said duty ratio of the current flowing through said DC control motor and for stopping said DC control motor for a predetermined time period when the time duration during which said duty ratio takes a value higher than a programmed duty ration reaches a pre-set time duration.

2. The control system for controlling said DC control motor according to claim I, wherein said monitoring means includes an adder-subtractor counter which subtracts a predetermined value every time when the current does not flow through said DC control motor and adds another predetermined value every time when the current flows through said DC control motor, and wherein said DC control motor is stopped when said adder-subtractor counter is in the underflow condition. takes a value higher than a programmed duty ratio reaches a pre-set time duration.

3. The control system for controlling said DC control motor according to claim 1, wherein said engine has an exhaust pipe and an exhaust gas control valve disposed at the vicinity of the downstream end of said exhaust pipe, and wherein said exhaust gas control valve is opened and closed by said DC control motor.

4. The control system for controlling said DC control motor according to claim 3, wherein said exhaust gas control valve is a butterfly valve.

5. The control system for controlling said DC control motor according to claim 1, wherein said means for detecting the operation condition of said engine comprises an ignition circuit for igniting said engine.

6. The control system for controlling said DC control motor according to claim 1, wherein said processor means, said discriminator means and said controller means are digital microprocessors.

7. A control system for controlling a DC control motor which controls an internal combustion engine to follow-up a target value varying continuously depending on the operation condition of said engine, said DC control motor being controlled through pulse width modulation, said control system comprising:

means for detecting the operation condition of said engine;

processor means for calculating and setting a target value depending on said operation condition of said engine;

detector means for detecting the up-to-date value of said DC control motor;

discriminator means for discriminating a difference between said target value and said up-to-date value to supply an output signal for changing the duty ratio of the current flowing through said DC control motor depending on said difference;

a driver for energizing said DC control motor in response to said output signal from said discriminator means; and monitor means for monitoring the changing rate of said up-to-date value and for increasing said duty ratio when said changing rate of said up-to-date value is less than a programmed rate.

8. The control system for controlling said DC control motor according to claim 7, wherein said engine has an exhaust pipe and an exhaust gas control valve disposed at the vicinity of the downstream end of said exhaust pipe, and wherein said exhaust gas control valve is opened and closed by said DC control motor.

9. The control system for controlling said DC control motor according to claim 8, wherein said exhaust gas control valve is a butterfly valve.

10. The control system for controlling said DC control motor according to claim 7, wherein said means for detecting the operation condition of said engine comprises an ignition circuit for igniting said engine.

11. The control system for controlling said DC control motor according to claim 7, wherein said processor means, said discriminator means and said monitor means are digital microprocessors.

* * * * *